US005291845A

United States Patent [19]

Vallery

[11] Patent Number: 5,291,845

[45] Date of Patent: Mar. 8, 1994

[54] MARINE DECK PLATE

[76] Inventor: Stafford J. Vallery, 3170 SE. Dominica Ter., Stuart, Fla. 34997

[21] Appl. No.: 983,886

[22] Filed: Dec. 1, 1992

[51] Int. Cl.[5] ..... B63B 19/12

[52] U.S. Cl. ..... 114/203; 220/243; 220/251; 114/201 R

[58] Field of Search ..... 114/227-229, 114/201 R, 203, 173-178, 211; 220/243, 251, 314

[56] References Cited

U.S. PATENT DOCUMENTS

| | | | |
|---|---|---|---|
| 194,402 | 8/1877 | Barns | 220/251 |
| 304,684 | 9/1884 | Adams | 114/201 R |
| 458,525 | 8/1891 | Farlow | 114/174 |
| 720,107 | 2/1903 | Brucker | 220/251 |
| 829,862 | 8/1906 | Ely | 114/203 |
| 849,618 | 4/1907 | Hurlburt | 114/174 |
| 891,174 | 6/1908 | Hurlburt | 114/174 |
| 1,324,981 | 12/1919 | Roesch | 220/251 |
| 2,448,838 | 9/1948 | Sohnlein | 220/251 |
| 2,546,760 | 3/1951 | Claire | 220/314 |
| 4,132,327 | 1/1979 | Van Dyke et al. | 220/251 |
| 4,246,859 | 1/1981 | Beckerer, Jr. | 114/201 |
| 4,385,580 | 5/1983 | Davidson | 114/201 |
| 4,964,659 | 10/1990 | Baldwin | 292/19 |

FOREIGN PATENT DOCUMENTS

| | | | |
|---|---|---|---|
| 1055684 | 11/1983 | U.S.S.R. | 114/227 |

OTHER PUBLICATIONS

Catalog, "Fish-On", 1989-1990, Tempress Incorporated pp. 12, 13, 14, 15.

Catalog, "Viking Marine", 1989, Viking Marine pp. 1, 2, 3, 5.

Catalog sheets, undated, Beckson Marine, Inc. pp. 9, 10, 11, 12, 13.

*Primary Examiner*—Ed Swinehart

*Attorney, Agent, or Firm*—Dennis T. Griggs

[57] ABSTRACT

A cover plate assembly for covering an access opening formed in a boat deck includes a cover plate for covering the access opening and engaging the exposed side of the deck which frames the access opening. A resilient O-ring gasket carried on the underside of the cover plate is compressed by the cover plate against the exposed surface of the deck. The cover plate and resilient seal are held in place by a retainer bar which is inserted through the access opening and engages the hidden side of the deck on opposite sides of the access opening. The cover plate is coupled to the retainer bar by a screw fastener which has a torque shaft and a manually operable handle. The torque shaft has a threaded shank coupled in threaded engagement with the retainer bar, and the torque shaft projects through the cover plate with the handle engaging the exposed side of the cover plate. As the handle is turned, the retainer bar is advanced into engagement with the underside of the deck, and the handle is drawn into engagement against the cover plate. The tension loading produced in the torque shaft is transmitted uniformly through the cover plate and sealing member for obtaining substantially uniform compression of the sealing member against the exposed deck surface.

11 Claims, 3 Drawing Sheets

MARINE DECK PLATE

FIELD OF THE INVENTION

This invention relates generally to marine accessories, and in particular to removable cover plates and hatches for providing access to bulkhead storage compartments and to below deck hold areas.

BACKGROUND OF THE INVENTION

Hatches and cover plates are known for providing access to below deck storage holds and compartments behind bulkheads, walls and panels. Equipment such as shut-off valves, electrical switches and monitoring gauges are located in protected areas below deck or behind bulkheads to protect such equipment from salt spray, inadvertent contact and unauthorized handling. A security compartment, sometimes referred to as a "cat bag" may be suspended from a deck plate for storage of personal items and valuables such as wallets,, keys, and ship's papers. Some boats provide an emergency compartment for holding first aid equipment, flares, magnetic compass and the like. Such equipment must be kept dry safe and readily accessible.

DESCRIPTION OF THE PRIOR ART

Conventional deck plates and hatch designs typically include a separate seating ring which is sealed and bolted to the deck or bulkhead. The deck plate or hatch is a separate member and is attached by large diameter perimeter threads, by a snap-fit, or by a cam lug fastener. The large diameter screw thread assembly is unreliable because of contamination by salt crystals and sand. It is necessary to seal the separate ring against the deck surface to provide a weather-tight system. Sealing compound and screw fasteners are needed for attachment of the seal ring to the mounting surface, requiring additional labor for mounting, applying the seal compound and cleaning up prior to installation of the deck plate or hatch.

The screw-out plate assembly is subject to leakage around the screws attaching the seating ring, in the interface between the ring and the mounting surface, between the hatch or deck plate and the seal ring gasket, and in the case of the quick-disconnect assembly, the locking lug shaft. The screw out plate assembly is also subject to jamming and cross threading due to the difficulty in maintaining manufacturing tolerances in the large diameter threads. Moreover, such large diameter threads are subject to distortion caused by warping and bending of the deck or bulkhead, for example in response to swelling and shrinking of structural timbers and other wooden components in response to exposure to water and ambient thermal cycling. These limitations make the existing hatches more difficult and expensive to install, awkward or difficult to remove, particularly in the presence of sand and salt crystals, and in general are neither water nor vapor tight.

OBJECTS OF THE INVENTION

The general object of the present invention is to provide a cover plate for use as a deck plate or hatch for covering an access opening in the deck or bulkhead of a boat, which overcomes the limitations of conventional deck plates and hatches.

Another object of the invention is to provide a water tight closure plate having a gasket sealing member which is uniformly sealed against the exposed surface bordering an access opening in a panel member, which does not require modification of the access opening or penetration of the panel member bordering the access opening.

Yet another object of the invention is to provide a compact cover plate for covering an access opening in a panel member which does not require a separate sealing ring or retainer device to be permanently installed onto the panel member, so that nothing is left in the access opening upon removal of the cover plate.

Another object of the invention is to provide a cover plate of the character described, which can be made in a round, square, oval or rectangular profile, and still provide uniform sealing pressure at the required sealing interface.

A related object of the invention is to provide a cover plate of the character described, which will uniformly load a sealing gasket so that it will accommodate irregularities in the mating surface.

Still another object of the invention is to provide a cover plate of the character described, which does not employ large diameter, perimeter screw threads for fastening.

Another object of the invention is to provide a cover plate of the character described, which can be quickly modified to accommodate a wide range of bulkhead and panel thicknesses.

Another object of the invention is to provide a cover plate assembly which provides quick and easy installation without the use of extra screws, bolts, or other fasteners and does not require the application of a sealant or caulk for providing water and vapor-tight service.

Still another object of the invention is to provide a water tight and vapor tight cover plate which is capable of sealing an access opening without leakage under two feet of water standing for at least seventy-two hours.

Still another object of the invention is to provide a cover plate/hatch assembly of the character described, and which is coupled by hinges to a panel, wall, bulkhead or deck for service as a door.

Yet another object of the invention is to provide a cover plate assembly of the character described, which provides for pressure equalization across the cover plate prior to disengagement and removal.

Another object of the invention is to provide a cover plate assembly of the character described, which includes a manually operable actuator which employs standard clockwise rotation to close and counterclockwise rotation to open, according to conventional, easily understood opening/closing techniques.

Still another object of the present invention is to provide a cover plate assembly of the character described, in which all components are corrosion resistant, lightweight, durable, water resistant, sunlight and solvent resistant.

SUMMARY OF THE INVENTION

The foregoing objects are achieved according to the present invention by a cover plate assembly for covering an access opening formed in a panel member, deck, wall or bulkhead. The cover plate assembly includes a cover plate or hatch having a central plate portion for covering the access opening and a peripheral edge portion for engaging the exposed side of the panel member bordering the access opening. The cover plate is coupled to a retainer bar having a central body member for spanning the access opening and first and second end portions for engaging the hidden side of the panel member bordering the access opening. An actuator assembly couples the central body member of the retainer bar to the central plate portion of the cover plate.

The actuator assembly is manually operable for moving the retainer bar relative to the cover plate from a first position in which the retainer bar is retracted toward the cover plate with the end portions being compressed against the hidden side of the panel member, to a second position in which the retainer bar is extended away from the cover plate and the end portions of the retainer bar are disengaged from the hidden side of the panel member. In the preferred embodiment, the actuator assembly includes a screw fastener having a threaded shank projecting through the cover plate and received in threaded engagement with the retainer bar. As the screw fastener is tightened, the retainer bar is advanced along the threaded shank, thereby drawing the retainer bar and cover plate into compression engagement against the panel member. A resilient seal member is compressed between the peripheral edge portion of the cover plate and the exposed side of the panel member bordering the access opening in reaction to the tension force load on the actuator shaft. The compression forces are distributed substantially uniformly across the resilient seal member by the cover plate.

The cover plate assembly is installed simply by inserting the retainer bar through the access opening and then centering the cover plate over the access opening with its peripheral edge portions overlapping the exposed side surfaces of the panel member bordering the access opening, and with the opposite end portions of the retainer bar overlapping the hidden surface portions of the panel member which border the underside of the access opening. The cover plate is then sealed against the access panel by turning the actuator until a predetermined compression and deformation of the resilient seal member is obtained.

The novel features of the invention are set forth with particularity in the claims. The invention will best be understood from the following description when read in conjunction with the accompanying drawings, wherein:

DETAILED DESCRIPTION OF THE PREFERRED EMBODIMENT

Figure 1:
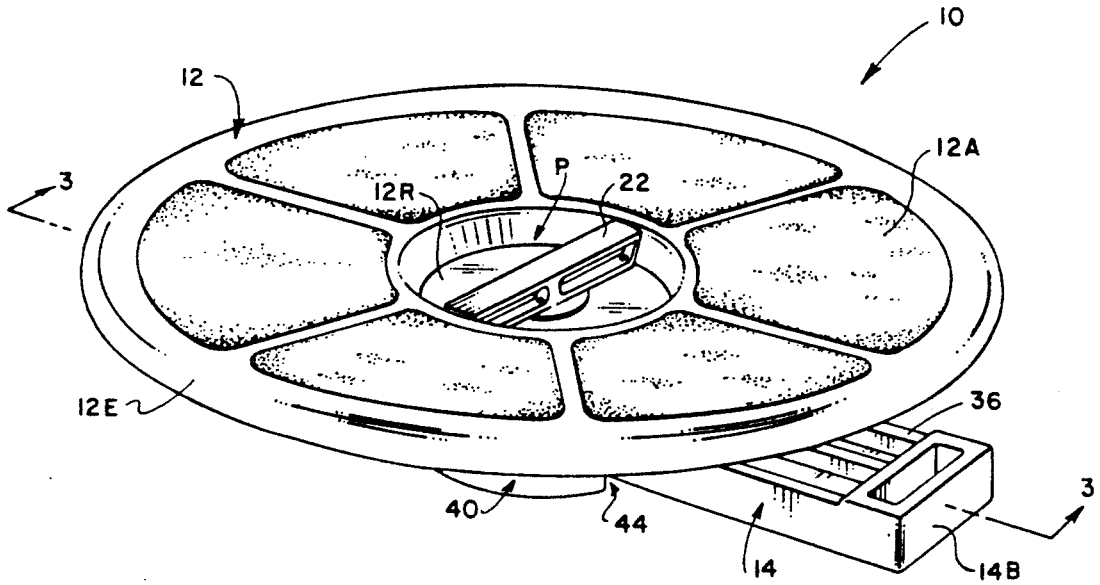
FIG. 1 is a perspective view of a cover plate assembly constructed according to the preferred embodiment of the present invention.

In the description which follows, like parts are marked throughout the specification and drawings with the same reference numerals, respectively. The drawings are not necessarily to scale the proportions of certain parts have been exaggerated to better illustrate details and features of the invention.

Figure 2:
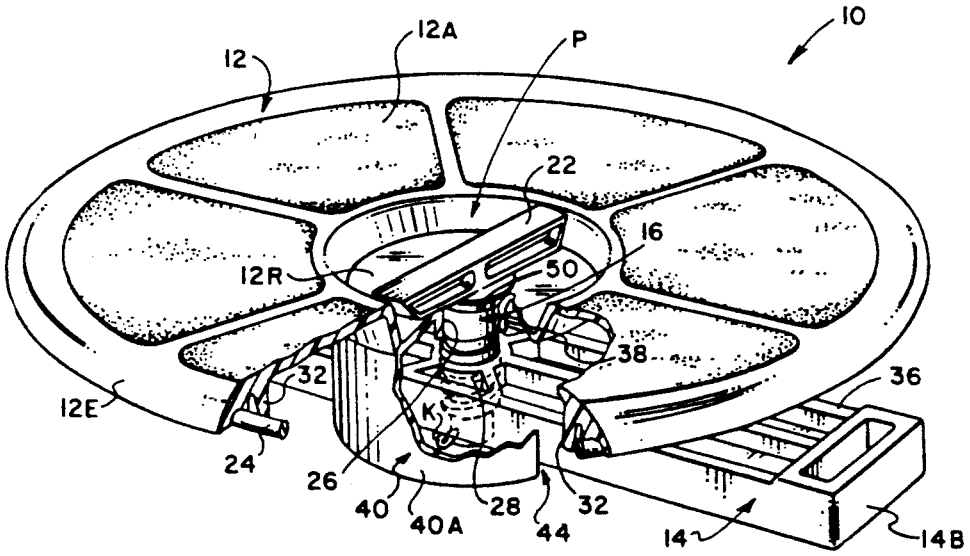
FIG. 2 is a view similar to FIG. 1, partially broken away and partially in section.
Figure 3:
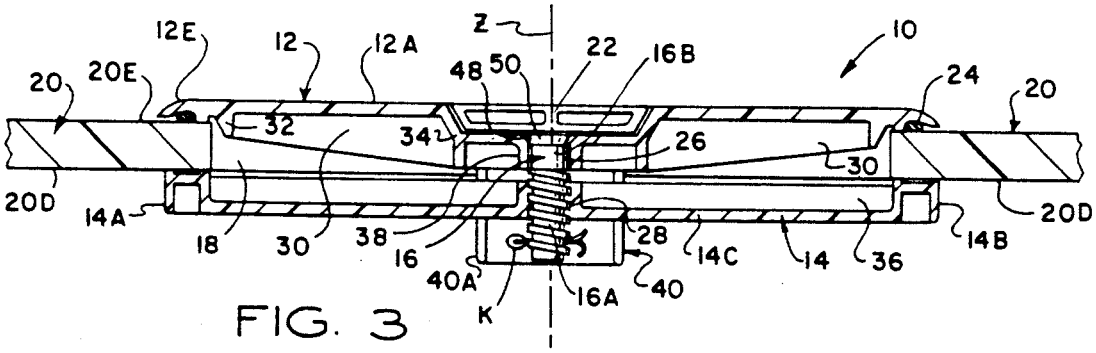
FIG. 3 is a sectional view thereof taken along the line 3—3 of FIG. 1.

A cover plate assembly 10 constructed according to the preferred embodiment of the present invention is shown in FIGS. 1–7. The principal components of the cover plate assembly 10 include a cover plate 12, a retainer bar 14 and an actuator assembly 16. Referring to FIG. 3, the cover plate assembly 10 is shown installed in sealing engagement over an access opening 18 formed in a panel member 20.

The cover plate 12 is coupled to the retainer bar 14 by the actuator 16. In the preferred embodiment, the actuator 16 is a torque shaft having a threaded shank portion 16A adapted for threaded engagement with the retainer bar 14 and a head portion 16B. A manually operable handle 22 is attached to the head portion 16B of the torque shaft 16, with the torque shaft projecting through the cover plate and the handle 22 engaging the exposed side of the cover plate 12.

According to one aspect of the invention, the cover plate 12 has a peripheral edge portion 12E which overlaps the exposed side surface 20E of the panel which borders the access opening 18. A resilient seal member 24 is carried on the underside of the peripheral edge portion 12B for engaging the exposed side surface 20E of the panel member 20. Preferably, the resilient seal member 24 is an O-ring gasket which is received in an annular groove 25 formed on the underside of the peripheral edge portion 12E. The underside surface 12F of the peripheral edge portion transitions along a sloping surface 12G to define a sloping cavity outward of the O-ring gasket 24 which permits the O-ring 24 to deform into a flattened ellipse without excessive crush.

The cover plate 12 has a central plate portion 12A for covering the access opening 18, with the peripheral edge portion engaging the exposed side of 20E of the panel member 20 which borders the access opening 18. The top of the central plate portion 12A is textured to provide a non-slip surface. The retainer bar 14 has a central body member 14C for spanning the access opening 18, and first and second end portions 14A, 14B for engaging the hidden side 20D of the panel member bordering the access opening 18.

The actuator assembly 16 is manually operable for moving the retainer bar 14 relative to the cover plate 12 from a first position in which the retainer bar 14 is retracted toward the cover plate and the first and second end portions 14A, 14B are driven into engagement against the hidden side 20D of the panel member, as shown in FIG. 3, to a second position in which the retainer bar 14 is extended away from the cover plate and the end portions 14A, 14B are disengaged from the hidden side 20D of the panel member 20. Operation of the actuator 16 is provided by rotating the handle 22 clockwise and counterclockwise.

As can best be seen in FIG. 3, the cover plate 12 is intersected by a central opening 26 with the torque shaft portion 16B projecting through the central opening, and the threaded shank portion 16A being received in threaded engagement with the retainer bar 14. For this purpose, the retainer bar 14 has a threaded receiver 28 with complementary threads for engaging the threaded shank portion 16A. In this arrangement, the cover plate 12 is intersected by the central opening 26 and the retainer bar is also intersected by the threaded bore of the receiver 28.

The cover plate 12 has a recessed web portion 12R which is axially inset with respect to the external surface 12A, thereby defining a pocket P. The inset web portion 12R is intersected by the central opening 26, with the handle 22 being received within the pocket P and engaging the inset web portion 12R with the torque shaft 16 projecting through the central opening 26.

Preferably, the threaded shank portion 16A is fitted with a helical ACME thread having a substantially square cross section and having a pitch in the range of from about three to about six turns per inch, and preferably four to five turns per inch. The threaded receiver 28 is intersected by mating groove for receiving the helical ACME threads.

According to this arrangement, the retainer bar 14 is advanced upwardly along the threaded shank 16A as the handle 22 is turned clockwise, until its end portions 14A, 14B engage against the underside surface 20D of the panel member 20. At the same time, the handle 22 is pulled downwardly against the recessed web portion 12R, thereby inducing a tension load within the torque mi shaft 16. As the tension load is increased, the panel member 20 and the O-ring gasket 24 are compressed.

Figure 5:
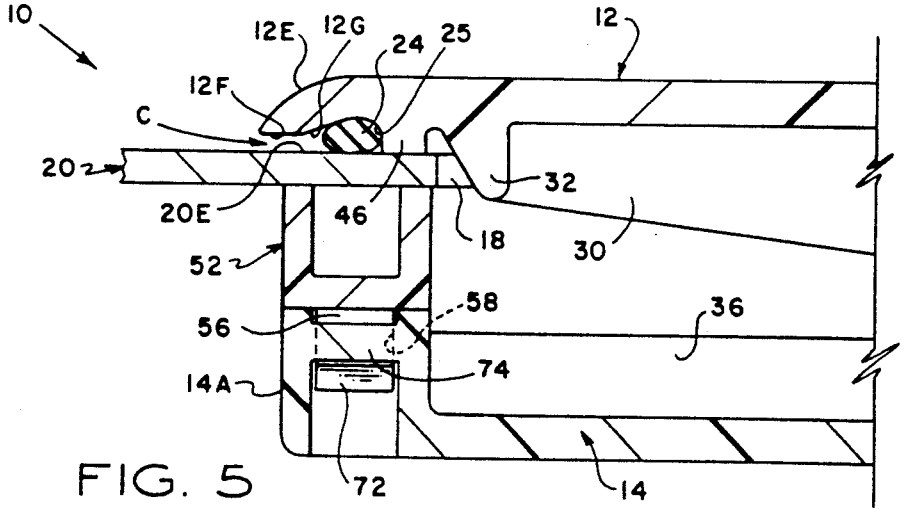
FIG. 5 is an enlarged sectional view of a portion of the assembly shown in FIG. 3, and including a spacer block coupled to the retainer bar for installation on a relatively thin panel member.

Referring to FIG. 5, the O-ring gasket 24 is deformed in response to the compression force transmitted through the torque shaft 16 and through the cover plate 12. According to an important aspect of the invention, the compression forces are transmitted substantially uniformly through the cover plate 12 and O-ring gasket 24. This is made possible by the central location of the actuator assembly 16 relative to the geometric center of the cover plate 12, with the tension loading in the torque shaft, 16 being reacted substantially uniformly through the symmetrical cover plate and the O-ring gasket 24.

The cover plate 12 is reinforced by multiple ribs 30 which are integrally formed with the cover plate 12. In the preferred embodiment, the cover plate has an annular locator shoulder 32 secured to the underside of the cover plate 12 intermediate the peripheral edge portion 12E and the central recessed web portion 12R. The locator shoulder 32 has an outside dimension which is less than the inside dimension of the panel member access opening 18. The purpose of the locator shoulder is to permit easy insertion of the retainer bar 14 and quick centering alignment of the cover plate 12 during initial installation.

The recessed cover plate web portion 12R is stabilized by an annular hub 34 which provides side walls for the pocket P and support for the recessed web portion 12R. The cover plate 12 is strengthened against distortion by the ribs 30 which project radially from along the underside of the cover plate 12 from the annular hub 34 to the annular locator shoulder 32.

Figure 6:
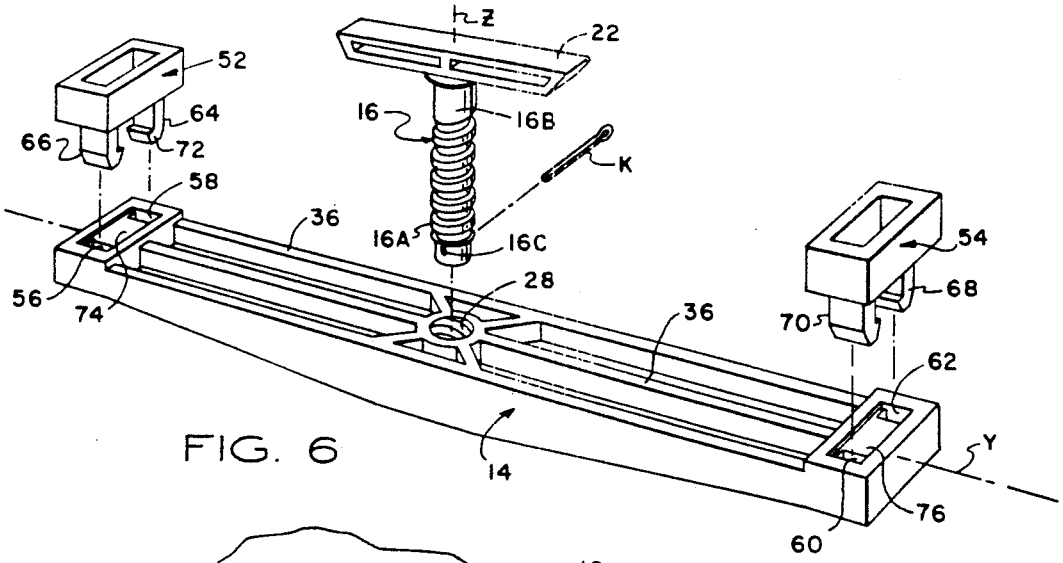
FIG. 6 is a perspective, exploded view of the retainer bar, spacer block and actuator shaft.

The ribs 30 also increase the spring modulus of the cover plate 12 for limiting the deflection of the cover plate 12 as the tension load in the torque shaft 16 is reacted through the deck plate 12 and retainer bar 14. The retainer bar 14 is also reinforced by a plurality of elongated ribs 36 which are integrally formed with the retainer bar 14, and Which extend along its length, as shown in FIG. 6.

Referring again to FIG. 3 and FIG. 4, the actuator torque shaft 16 is maintained in perpendicular relation to the cover plate 12 by a guide collar 38 which is secured to the underside of the recessed cover plate web portion 12R. The guide collar has a tubular side wall centered in coaxial alignment with the central opening 26 of the recessed cover plate web portion for receiving and guiding the coupling shaft 16. Parallel orientation of the retainer bar 14 with the cover plate 12 is provided by a retainer collar 40 which is secured to the underside of the cover plate 12. The retainer collar 40 has a tubular side wall which is intersected on diametrically opposite sides by first and second retainer slots 42, 44, respectively.

The intermediate body portion 14C of the retainer is received within the retainer slots with its longitudinal axis Y being maintained substantially parallel with the cover plate 12, and perpendicular to the longitudinal axis Z of the coupling shaft 16. The retainer slots 42, 44 provide a lateral space between opposite collar sections 40A, 40B. In this embodiment, the slots between the collar sections 40A, 40B permit sliding movement of the retainer 14 as the coupling shaft 16 is rotated clockwise or counterclockwise. The collar sections 40A, 40B engage the opposite sides of the retainer bar 14, preventing its rotation as the coupling shaft 16 is turned, thus constraining the retainer bar 14 to be extended and retracted along the longitudinal axis Z of the coupling shaft 16

A retainer key K is fitted through an aperture 16C which radially intersects the threaded shank portion 16A of the coupling shaft 16. The retainer key K prevents the operator from inadvertently unscrewing the retainer bar 14 off the end of the coupling shaft 16.

The threaded shank portion 16A of the coupling shaft 16 preferably has an ACME thread, which is a helical thread having a substantially square cross-section, and having a pitch in the range of from about three to about six turns per inch. A pitch of from about 4 to about 5 turns per inch is preferred for quick opening and closure.

Figure 4:
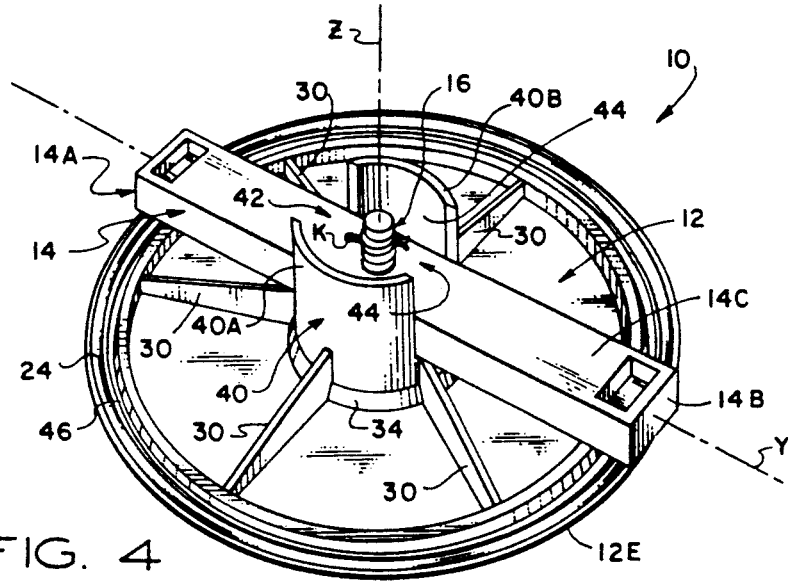
FIG. 4 is an inverted, perspective view thereof.

The only two areas where leakage can occur is between the peripheral edge portion 12E and the exposed panel surface 20E, and in the interface between the coupling shaft 16 and the cover plate 12. The outer perimeter of the cover plate 12 is securely sealed by the resilient O-ring gasket 24. Referring to FIG. 4 and FIG. 5, the cover plate has annular boss 46 which extends completely around the underside of the peripheral edge portion 12E and forms one side boundary of the O-ring groove 25. The annular boss 46 has an axial projection relative to the underside 12F of the peripheral edge portion 12E which is a fraction of the unloaded axial projection of the resilient seal member relative to the underside surface 12F of the peripheral edge portion. As used herein, "unloaded axial projection" refers to the unloaded (uncompressed) diameter of the resilient seal member 24, as shown in FIG. 2. The loaded (compressed) axial projection of the resilient seal member 24 is shown in FIG. 5, in which the seal member is deformed into a flattened ellipse.

Referring to FIG. 2, it will be seen that the unloaded axial projection of the resilient seal member 24 relative to the underside surface 12F is about 30 percent greater than the corresponding axial projection of the annular boss 46. However, upon complete compression and sealing engagement as shown in FIG. 5, the annular O-ring member 24 is compressed and deformed and the annular boss 46 is driven into surface engagement against the exposed surface 20E of the panel member, thus preventing excessive compression and deformation of the annular O-ring seal member 24. The sealing gasket 24 has a design which will allow approximately one-third of its radial projection to accommodate a sealing crush. This particular sealing structure will accommodate irregularities in the exposed sealing surface 20E.

It is common for the O-ring gasket 24 to become stuck to a painted surface of the panel 20. The clearance C between the panel surface 20E and the underside 12F of the cover plate 12 is maintained by the annular boss 46. This provides a finger hold for the operator to pick up the cover plate 12 and release the seal for removal.

The only other region where leakage could possibly occur is through the interface between the coupling shaft 16 and the cover plate 12. That interface is securely sealed according to one aspect of the present invention by an annular sealing surface 48 which is concentrically disposed about the central opening 26. In the preferred embodiment, the annular sealing surface 48 is formed by a tapered bore formed in the inset web plate portion 12R. The coupling shaft 16 carries a tapered shoulder 50 which is adapted for sealing engagement against the tapered annular sealing surface 48 which opens into the bore of the guide collar 38. When the coupling shaft 16 is fully inserted through the guide collar 38, the handle 22 engages the recessed cover plate web portion 12R, and the tapered shoulder 50 engages the tapered sealing surface 48. In this arrangement, the annular seal member 48 is a tapered seat, and the tapered shoulder 50 is integrally formed with the coupling shaft 16 in the form of a conical plug having a tapered face 50 which is adapted for sealing engagement against the tapered seat 48.

The tapered sealing face 50 formed on the torque shaft 16 slopes transversely with respect to the longitudinal axis Z of the torque shaft, and the annular sealing surface 48 of the cover plate slopes approximately in parallel with the torque shaft sealing face 50, thus permitting insertion of the conical plug portion of the torque shaft within the tapered seat pocket 48. Preferably, the tapered sealing face 50 and the sealing surface 48 of the cover plate are within about 40 of parallel alignment with each other.

It will be appreciated that the panel wall thickness and bulkhead thickness may vary from one installation to another. Variable panel thickness is accommodated, according to the present invention, by a pair of spacer blocks 52, 54 as shown in FIG. 5 and FIG. 6. In the installation of FIG. 3, a spacer block is not needed, since the wall thickness of the panel 20 is great enough to permit tension loading to be produced in the coupling shaft 16 before reaching the limit of threaded engagement. However, for some installations having a thin panel wall as shown in FIG. 5, the limit of threaded engagement between the torque shaft 16A and the retainer bar is reached before the opposite end portions engage the underside 20D of the panel member 20.

This limitation is overcome by the spacer blocks 52, 54 which are adapted for press-fit coupling engagement with the opposite end portions 14A, 14B of the retainer bar. In this arrangement, the opposite end portions of the retainer bar are each intersected by socket openings 56, 58 and 60, 62 respectively. Each spacer block 52 has a press-fit coupling member in the form of laterally spaced latch arms 64, 66 and 68, 70, respectively. A detent shoulder 72 projects transversely from each latch arm. Upon insertion of the latch arms into the sockets, the detent shoulders deflect outwardly until they clear the retainer webs 74, 76. Upon full insertion and clearance of the retainer web, the latch arms deflect inwardly, with the detent shoulders engaging the underside of the retainer webs. The spacer blocks 52; 54 can be removed simply by pulling the blocks hard enough to overcome the detented engagement.

Figure 7:
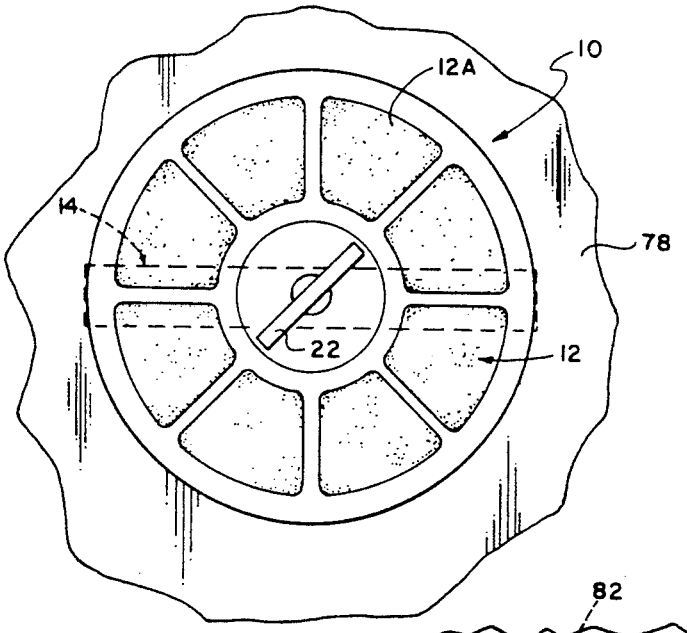
FIG. 7 is a top plan view of the cover plate assembly of FIG. 1 shown installed over an access opening of a boat deck; and, FIG. 8 is a top plan view of an alternative embodiment of the invention, in which the cover plate assembly has a rectangular configuration and is coupled to a deck panel by hinges.

It will be appreciated that the cover plate can be fabricated in round, square, oval or rectangular dimensions and still provide uniform sealing pressure at the required sealing surfaces. Referring to FIG. 7, the cover plate 12 has a round configuration and is installed over an access opening formed in a boat deck 7 8. Moreover, the panel members 20 illustrated in FIG. 3 and FIG. 5 may form a part of a boat deck, bulkhead, wall or panel. Preferably, in such installations, the length of the retainer bar 36 is substantially coextensive with the diameter of the deck plate 12. The overall length of the retainer bar 36 should be at least great enough to engage the hidden side surfaces 20D of the panel 20 which border the access opening 18, so that a compression force can be developed and applied across the sealing ring 24. The overall length of the retainer bar 14, including its opposite end portions, need only be great enough to ensure overlapping engagement with the panel portions on opposite sides of the access opening 18 when the cover plate 12 is centered over the access opening. Of course, the overall length of the retainer bar together with its opposite end portions may be greater than the diameter of the cover plate 12, but its length should be limited so that it will not interfere with insertion and removal.

Figure 8:
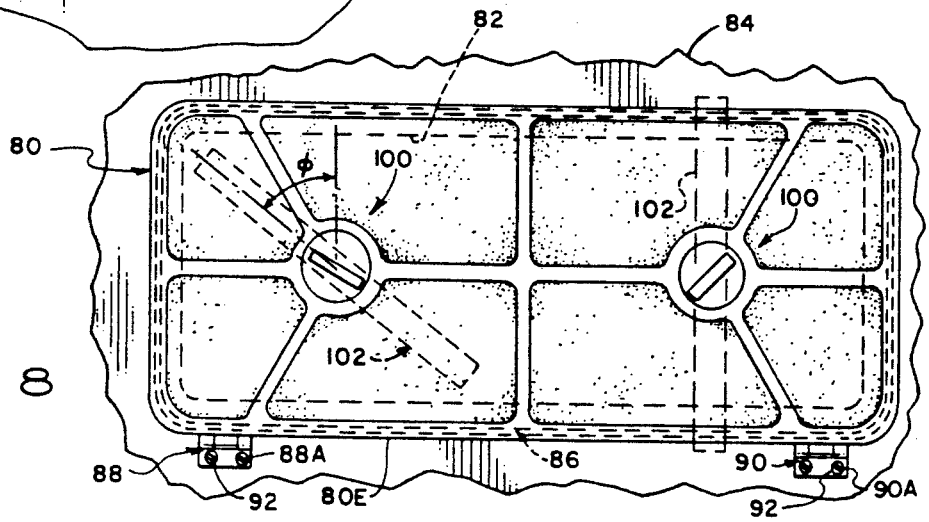

Referring now to FIG. 8, a cover plate in the form of a hatch door 80 is shown installed over a rectangular access/door opening 82 formed in a panel member 84. In this arrangement, the hatch door 80 has a rectangular perimeter which is sealed by an O-ring gasket 86 which extends completely around the peripheral edge portion 80E. In this embodiment, the hatch door 80 is pivotally coupled to the panel member 84 by hinges 88, 90. The hinges include mounting plates 88A, 90A which are secured to the panel member 84 by screw fasteners 92. The hatch door 80 is thus adapted for pivoting movement between a door closed position as shown in FIG. 8, to an open position (not illustrated).

In this alternative embodiment, the hatch door 80 is sealed against the panel 84 by dual sealing assemblies 100, which except for the rectangular configuration of the hatch door 80, are constructed to the seal assembly 100 shown in FIG. 3 and FIG. 4. One difference is that each assembly includes a retainer bar 102 and a retainer collar 40 in which the retainer slots 42, 44 are enlarged to allow angular rotation of the retainer bar through angle $\phi$ of approximately 45 degrees as shown in FIG. 8. This permits the retainer bars to be rotated out of engagement with the bordering panel surface so that the hatch door 80 can be lifted and opened. In the rectangular hatch embodiment shown in FIG. 8, the hatch door 80 has a length dimension which exceeds its width dimension, and the retainer bar 102 has a length dimension which is substantially coextensive with the width dimension. However, the length of the retainer bar 102 in the rectangular hatch configuration of FIG. 8 is limited so that when it is rotated in alignment with the diagonal, it lies completely inside of the access door opening 82.

Those skilled in the art will appreciate that a variety of changes and modifications to the embodiments disclosed herein can be made without departing from the spirit and scope of the invention as defined by the appended claims. Although the exemplary embodiment is for marine applications, it will be understood that the removable cover plate assembly of the present invention may be used to good advantage as a dust and water tight access plate for land vehicles, machinery, equipment panels, aircraft and the like.

I claim:

1. A cover plate assembly for covering an access opening formed in a panel member having an exposed side and a hidden side comprising, in combination:

a cover plate having a central plate portion for covering the access opening and having a peripheral edge portion for engaging the exposed side of the panel member bordering the access opening;

a retainer bar having a central body member for spanning the access opening and first and second end portions for engaging the hidden side of the panel member bordering the access opening;

an actuator assembly coupling the central body member of said retainer bar to the central plate portion of the cover plate, said actuator assembly being manually operable for moving said retainer bar relative to said cover plate from a first position in which the retainer bar is retracted toward said cover plate and the first and second end portions are engaged against the hidden side of the panel member, to a second position in which said retainer bar is extended away from said cover plate and said end portions are disengaged from the hidden side of the panel member, a compressive, resilient seal member disposed on the peripheral edge portion of said cover plate for engaging the exposed side of the panel member bordering the access opening and sealing the interface between said cover plate and the panel member in response to compression of said seal member between said cover plate and panel member; and said cover plate having a sloping surface and an annular boss disposed on the peripheral edge portion, said annular boss having an axial projection relative to the cover plate which is a fraction of the unloaded axial projection of said seal member relative to the peripheral edge portion, and said cover plate having an annular pocket disposed between the annular boss and the sloping face for receiving said seal member.

2. A cover plate assembly as defined in claim 1, said cover plate having a recessed web portion defining a pocket and said actuator assembly having a coupling shaft and a handle attached to said coupling shaft, said recessed web portion being intersected by an opening, said coupling shaft projecting through the opening and said handle being received within the cover plate pocket.

3. A cover plate assembly as defined in claim 1, including a retainer collar secured to said cover plate, said retainer collar having a sidewall which is intersected on opposite sides by first and second retainer slots, respectively, the central body member of said retainer bar being received within said retainer slots and the first and second end portions of said retainer bar projecting away from said retainer collar.

4. A cover plate assembly as defined in claim 1, including an annular locator shoulder secured to said cover plate intermediate the peripheral edge portion and the central plate portion, said locator shoulder having an outside dimension which is less than the inside dimension of the panel member access opening to permit insertion and close registration of said locator shoulder within the panel member access opening and centering of the cover plate over the access opening.

5. A cover plate assembly as defined in claim 1, including an annular hub attached to said central plate portion, an annular should attached to said cover plate intermediate the peripheral edge portion and the central plate portion, and a plurality of ribs projecting radially from said hub to said locator shoulder.

6. A cover plate assembly as defined in claim 1, said cover plate including a web portion axially offset with respect to said central plate portion, an annular hub connecting said web portion to said central plate portion thereby defining a pocket, said web portion being intersected by a central opening and said actuator assembly including an operating handle, an actuator shaft attached to the operating handle and projecting through said central opening, said operating handle being received within said pocket and said actuator shaft being coupled to said retainer bar.

7. A cover plate assembly for covering an access opening formed in a panel member having an exposed side and a hidden side comprising, in combination:

a cover plate having a central plate portion for covering the access opening and having a peripheral edge portion for engaging the exposed side of the panel member bordering the access opening;

said cover plate having a recessed web portion defining a pocket and said actuator assembly having a coupling shaft and handle attached to said coupling shaft, said recessed web portion being intersected by an opening, said coupling shaft projecting through the opening and said handle being disposed within the cover plate pocket;

a retainer bar having first and second end portions for engaging the hidden side of the panel member bordering the access opening;

an actuator assembly coupling said retainer bar to the central plate portion of the cover plate, said actuator assembly being manually operable for moving said retainer bar relative to said cover plate from a first position in which the retainer bar is retracted toward said cover plate and the first and second end portions are engaged against the hidden side of the panel member, to a second position in which said retainer bar is extended away from said cover plate and said end portions are disengaged from the hidden side of the panel member; and, a guide collar secured to the cover plate, said guide collar having a tubular sidewall disposed in alignment with the opening in the recessed web portion for receiving and guiding said coupling shaft.

8.

A cover plate assembly for covering an access opening formed in a panel member having an exposed side and a hidden side comprising, in combination:

a cover plate having a central plate portion for covering the access opening and having a peripheral edge portion for engaging the exposed side of the panel member bordering the access opening;

a retainer bar having a central body member for spanning the access opening and first and second end portions for engaging the hidden side of the panel member bordering the access opening;

an actuator assembly the central body member of said retainer bar to the central plate portion of the cover plate, said actuator assembly being manually operable for moving said retainer bar relative to said cover plate from a first position in which the retainer bar is retracted toward said cover plate and the first and second end portions are engaged against the hidden side of the panel member, to a second position in which said retainer bar is extended away from said cover plate and said end portions are disengaged from the hidden side of the panel member; and, the first and second end portions of said retainer bar each being intersected by an opening defining first and second sockets, respectively, for engaging a press-fit coupling member, and including first and second removable spacer blocks coupled to the first and second end portions, respectively, each spacer block having a press-fit coupling member inserted within one of said sockets.

9. A cover plate assembly s defined in claim 8, wherein each retainer bar end portion has two laterally spaced socket openings, and each spacer block has two laterally spaced press-fit coupling members adapted for releasable, interlocking engagement with said retainer bar.

10. A cover plate assembly as defined in claim 9, each press-fit coupling member comprising a resilient latch arm and a detent shoulder projecting transversely from said latch arm.

11.

A cover plate assembly for covering an access opening formed in a panel member having an exposed side and a hidden side comprising, in combination:

a cover plate having a plate portion for covering the access opening and having a peripheral edge portion for engaging the exposed side of the panel member bordering the access opening;

a retainer bar having a body member for spanning the access opening and first and second end portions for engaging the hidden side of the panel member bordering the access opening;

an actuator assembly coupling the body member of said retainer bar to the plate portion of the cover plate, said actuator assembly being manually operable for moving said retainer bar relative to said cover plate from a first position in which the retainer bar is retracted toward said cover plate and the first and second end portions are engaged against the hidden side of the panel member, to a second position in which said retainer bar is extended away from said cover plate and said end portions are disengaged from the hidden side of the panel member;

said cover plate having side portions defining a rectangular perimeter, and said retainer bar having a length dimension which is substantially coextensive with one of said side portions; and, a hinge assembly attached to said cover plate, said hinge assembly having a mounting plate adapted for attachment to the exposed side of said panel member.

* * * * *